US008316988B2

(12) United States Patent
Russell

(10) Patent No.: US 8,316,988 B2
(45) Date of Patent: Nov. 27, 2012

(54) SHOCK ABSORBING FABRIC STRUCTURES

(75) Inventor: Timothy M. Russell, Anniston, AL (US)

(73) Assignee: YKK Corporation of America, Marietta, GA (US)

( * ) Notice: Subject to any disclaimer, the term of this patent is extended or adjusted under 35 U.S.C. 154(b) by 335 days.

(21) Appl. No.: 12/855,286

(22) Filed: Aug. 12, 2010

(65) Prior Publication Data

US 2012/0040579 A1 Feb. 16, 2012

(51) Int. Cl.
*A47L 3/00* (2006.01)
*A62B 35/00* (2006.01)

(52) U.S. Cl. ..... 182/3

(58) Field of Classification Search ..... 182/3
See application file for complete search history.

(56) References Cited

U.S. PATENT DOCUMENTS 2,365,184 A * 12/1944 Frieder et al. ..... 244/145
2,643,686 A * 6/1953 Richards ..... 139/421
2,681,667 A 6/1954 Slaughter
3,444,957 A 5/1969 Ervin, Jr.
3,550,956 A 12/1970 Lowe
3,550,957 A 12/1970 Radke et al.
3,804,698 A 4/1974 Kinloch
3,861,744 A 1/1975 Yamada et al.
3,872,895 A 3/1975 Takada
3,978,894 A 9/1976 Boone
3,997,190 A 12/1976 Seiffert et al.
4,004,616 A 1/1977 Andronov et al.
4,138,157 A 2/1979 Pickett et al.
4,209,044 A 6/1980 Taki
4,253,544 A 3/1981 Dalmaso
4,515,254 A 5/1985 Markov et al.
4,538,702 A 9/1985 Wolner
4,571,765 A 2/1986 Okada et al.
4,604,315 A 8/1986 McCall et al.
4,618,026 A 10/1986 Olson
4,662,487 A 5/1987 Koch
4,745,883 A 5/1988 Baggetta
4,746,769 A 5/1988 Piper
4,853,175 A 8/1989 Book, Sr.
4,853,275 A 8/1989 Tracy et al.

(Continued)

FOREIGN PATENT DOCUMENTS

EP 0034458 8/1981

(Continued)

OTHER PUBLICATIONS

Japanese Patent Application No. 2011-500826, Office Action mailed Jun. 19, 2012 (4 pages).

(Continued)

*Primary Examiner* — Alvin Chin Shue
(74) *Attorney, Agent, or Firm* — Kilpatrick Townsend & Stockton LLP

(57) ABSTRACT

Fabric structures having elongation yarns and ground yarns that form a sheath are provided, with the structure having two connection segments and at least one expansion segment in between the connection segments. Heat treatment of the one or more expansion segments shrinks the length of the elongation yarns during manufacture. A tensile load applied to the fabric structure stretches the elongation yarns and unfolds the gathered sheath. The elongation yarns absorb energy as the fabric structure elongates. In some embodiments, the fabric structure has more than one expansion segment so that the deployment force of the structure is not constant. In some embodiments, the fabric structure includes a band in some portions.

6 Claims, 14 Drawing Sheets

U.S. PATENT DOCUMENTS

| | | | | |
|---|---|---|---|---|
| 4,897,902 | A | 2/1990 | Kavesh et al. | |
| 5,027,477 | A | 7/1991 | Seron | |
| 5,045,018 | A * | 9/1991 | Costanzo | 450/31 |
| 5,113,981 | A | 5/1992 | Lantz | |
| 5,143,187 | A | 9/1992 | McQuarrie et al. | |
| 5,174,410 | A | 12/1992 | Casebolt | |
| 5,202,177 | A | 4/1993 | Kamper | |
| 5,287,943 | A | 2/1994 | Bell | |
| 5,433,290 | A | 7/1995 | Ellis et al. | |
| 5,464,252 | A | 11/1995 | Kanazawa et al. | |
| 5,478,636 | A | 12/1995 | Koseki | |
| 5,529,343 | A | 6/1996 | Klink | |
| 5,564,476 | A | 10/1996 | Golz | |
| 5,598,900 | A | 2/1997 | O'Rourke | |
| 5,658,012 | A | 8/1997 | Villarreal et al. | |
| 5,799,760 | A | 9/1998 | Small | |
| 6,006,860 | A | 12/1999 | Bell | |
| 6,085,802 | A | 7/2000 | Silberberg | |
| 6,283,167 | B1 | 9/2001 | Chang et al. | |
| 6,299,040 | B1 | 10/2001 | Matias | |
| 6,347,466 | B1 | 2/2002 | Lackner et al. | |
| 6,390,234 | B1 | 5/2002 | Boyer | |
| 6,533,066 | B1 | 3/2003 | O'Dell | |
| 6,648,101 | B2 | 11/2003 | Kurtgis | |
| 6,739,427 | B2 | 5/2004 | Gayetty | |
| 6,776,317 | B1 | 8/2004 | Parker | |
| 7,413,802 | B2 | 8/2008 | Karayianni et al. | |
| 7,665,288 | B2 | 2/2010 | Kaayianni et al. | |
| 7,665,575 | B2 | 2/2010 | Tanaka et al. | |
| 7,677,360 | B2 | 3/2010 | Tanaka et al. | |
| 7,726,350 | B2 | 6/2010 | Jennings et al. | |
| 2002/0180199 | A1 | 12/2002 | Schneider et al. | |
| 2003/0069557 | A1 | 4/2003 | Driskell et al. | |
| 2003/0173150 | A1 | 9/2003 | Sharp | |
| 2004/0173276 | A1 | 9/2004 | Horikawa | |
| 2005/0056335 | A1 | 3/2005 | Tielemans et al. | |
| 2005/0189169 | A1 | 9/2005 | Tanaka et al. | |
| 2006/0027277 | A1 | 2/2006 | Jennings et al. | |
| 2007/0210639 | A1 | 9/2007 | Berger et al. | |
| 2009/0023352 | A1 | 1/2009 | Russell et al. | |
| 2011/0103558 | A1 * | 5/2011 | Hooten | 379/37 |

FOREIGN PATENT DOCUMENTS

| | | | |
|---|---|---|---|
| EP | 0128662 | A2 | 12/1984 |
| EP | 0496028 | | 7/1992 |
| EP | 0665142 | | 11/1996 |
| EP | 0851779 | B1 | 8/2000 |
| EP | 1069008 | A1 | 1/2001 |
| EP | 0923403 | | 4/2003 |
| JP | S50-88684 | | 12/1973 |
| JP | S59-500450 | | 3/1984 |
| JP | S64-53777 | | 4/1989 |
| JP | H03-185150 | | 8/1991 |
| JP | 05084317 | | 4/1993 |
| JP | 05141102 | | 6/1993 |
| JP | 06081244 | | 3/1994 |
| JP | U1-9466714 | | 9/1994 |
| JP | 07246909 | | 9/1995 |
| JP | 08182770 | | 7/1996 |
| WO | WO-9312838 | | 7/1993 |
| WO | WO-9710876 | | 3/1997 |
| WO | WO-9841284 | | 9/1998 |
| WO | WO-0126738 | | 4/2001 |
| WO | WO-2007011336 | | 1/2007 |
| WO | WO-2007021278 | | 2/2007 |
| WO | WO-2009128976 | | 10/2009 |

OTHER PUBLICATIONS

International Application Serial No. PCT/US2009/033431, International Search Report and Written Opinion Mailed May 8, 2009.

PCT/US2005/025043, International Search Report and Written Opinion, Nov. 1, 2005.

PCT/US2005/029140, International Search Report, Jan. 13, 2006.

* cited by examiner

SHOCK ABSORBING FABRIC STRUCTURES

CROSS REFERENCE TO RELATED APPLICATIONS

This application is related to U.S. application Ser. No. 12/183,491 titled "Shock Absorbing Fabric Structures" filed Jul. 31, 2008, which is a continuation-in-part of U.S. application Ser. No. 12/103,565 titled "Shock Absorbing Lanyards" filed Apr. 15, 2008, which issued as U.S. Pat. No. 7,677,360 on Mar. 16, 2010 and which is a continuation of U.S. application Ser. No. 10/790,394 titled "Shock Absorbing Lanyards" filed Mar. 1, 2004, all of which are incorporated herein by this reference.

BACKGROUND OF THE INVENTION

People at elevated positions above a floor or other relatively lower surface are at risk of falling and injury. For example, workers and other personnel who have occupations that require them to be at elevated positions, such as on scaffolding, are at risk of falling and injury. Safety harnesses are often worn to stop a person's fall and prevent or reduce injury.

Safety harnesses typically have a harness portion worn by the user and a tether or lanyard extending from the harness portion. The lanyard connects the harness portion to a secure structure. If a person falls from the elevated position, the safety harness stops the person's fall when the lanyard is straightened.

A load limiter on a seat belt system can be worn to secure the occupant of a vehicle in the event of a sudden stop or collision to reduce the risk of injury. If a person is subjected to inertia due to a vehicle's sudden stop, the load limiter limits the forces felt by the person during the person's forward movement and also limits the person's forward movement when the load limiter is extended.

Lanyards that attempt to absorb the shock of a person's fall or sudden stop are known. Current lanyards have been made from two separate webbings assembled together. One webbing is a narrow, flat webbing woven of partially oriented yarn (POY webbing) and the other webbing is a relatively higher strength tubular-shaped webbing. After manufacture of the two webbings, the POY webbing is inserted into one end of the tubular-shaped webbing and pulled through the tubular-shaped webbing. A hook or other device inserted into the opposite end of the tubular-shaped webbing is then used to pull the POY webbing through the tubular-shaped webbing so that the POY webbing extends inside of the tubular-shaped webbing from one end to the opposite end. The relative lengths of the POY webbing and the tubular-shaped webbing then must be adjusted. To adjust the relative lengths, while holding the POY webbing in place, one end of the tubular-shaped webbing is moved closer to the opposite end to place the tubular-shaped webbing in an accordion-like position over the POY webbing. The relative length adjustment of the webbings is performed manually and is a significant disadvantage of existing lanyards. After the manual adjustment of the relative webbing lengths, the POY webbing is essentially in a straight, linear orientation inside of the accordion-shaped orientation of the tubular-shaped webbing. The two webbings are then attached to each other by sewing at the ends. Any excess POY webbing extending out of the ends of the tubular-shaped webbing is cut off and discarded.

Because conventional lanyards are made from two separate webbings that must be assembled together, manufacture of the lanyards requires costly and tedious assembly processes, such as inserting the POY webbing through the tubular-shaped webbing. Moreover, after the insertion process, an additional manual process is required that adjusts the relative webbing lengths by placing the tubular-shaped webbing in the accordion position while maintaining the POY webbing in a straight position. Then, another process is required to attach the two separate webbings together while maintaining the POY webbing in the straight position and the tubular-shaped webbing in the accordion-shaped position. The relative lengths of the POY webbing and the tubular-shaped webbing is critical for proper functioning of the lanyard. The manufacturing process is complicated by proper control and manual setting of the critical relative lengths of the two webbings.

In addition, existing lanyards using POY webbings have a constant deployment force, which refers to the energy absorption or energy dissipation rate provided by the webbing. A deployment force is often shown in graphical form as the applied force to a load. Deployment force is determined by the number of POY yarns in the lanyard. Because the deployment force of existing lanyards is constant and consistent throughout deployment, the lanyard is not well suited for all types of users. For example, a lanyard having a relatively high deployment force may not be suitable for use with a child, who would experience more shock associated with a fall or sudden stop if the force of the fall or stop was not enough to activate the shock absorbing feature of the lanyard. Similarly, a lanyard having a relatively low deployment force may not be suitable for use with a heavy user if the configuration of the lanyard is not sufficient to stop the fall or limit forward movement.

Existing lanyards that purport to reduce shock can be found in U.S. Pat. Nos. 5,113,981; 6,085,802; 6,390,234; and 6,533,066 and WIPO Publication No. WO/01/026738.

SUMMARY OF THE INVENTION

Certain embodiments of the invention generally pertain to fabric structures, such as lanyards and shock absorbing and load limiting lanyards, and methods of making them. More specifically, some embodiments of the invention pertain to shock absorbing and force limiter structures having a shock absorbing member and a load bearing member, wherein the shock absorbing member is shorter than the load bearing member and wherein the deployment force of the fabric structure gradually increases the further the fabric structure is stretched. In some embodiments, the fabric structure includes a band that prevents slight extension of the structure when it is subjected to small loads. In some embodiments, the fabric structure includes elastic to constrict the fabric structure to reduce the amount of extra fabric before the structure is deployed.

DETAILED DESCRIPTION OF THE INVENTION

Certain embodiments of the invention provide fabric structures configured to support a load applied to the structure after elongation yarns of certain segments elongate under the load. Fabric structures having a deployment force that gradually increases the further the fabric structure is stretched will be discussed first, along with several variations of the structure to achieve this feature. Next, fabric structures having bands will be discussed.

Figure 1:
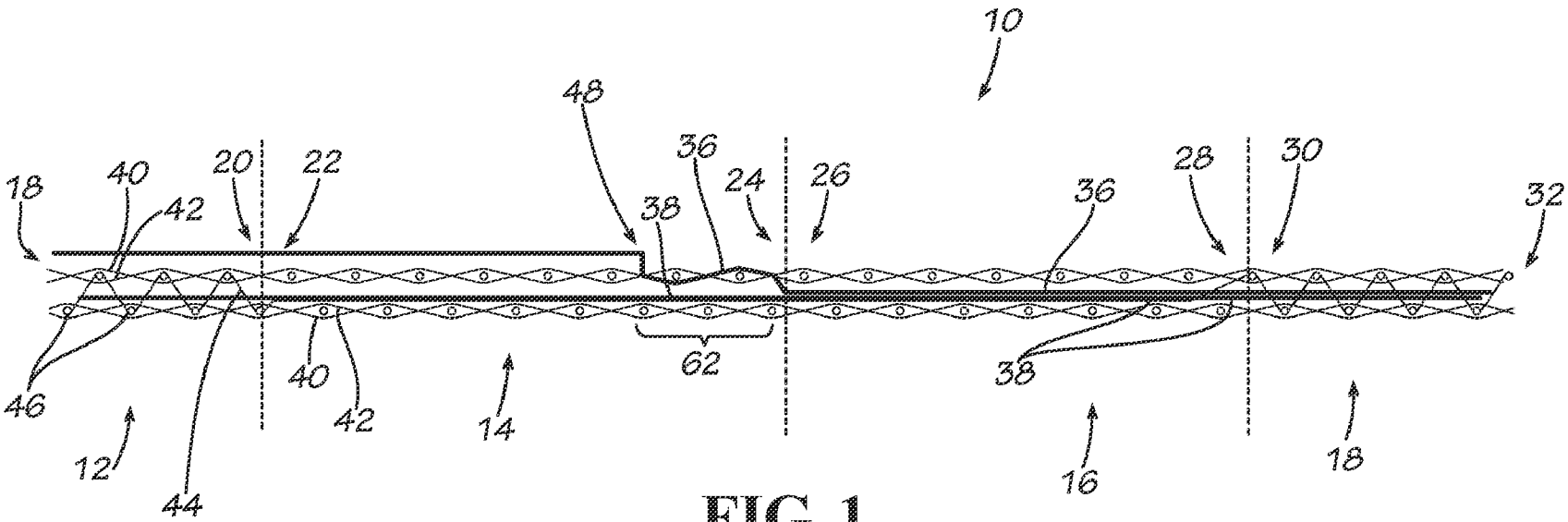
FIG. 1 is a cross-sectional view of a weaving pattern of a fabric structure according to one embodiment of the invention.

As shown in FIG. 1, fabric structure 10 according to one embodiment comprises a first connection segment 12, a second expansion segment 14, a third expansion segment 16, and a fourth connection segment 18. The first connection segment 12 includes a first end 19 and a second end 20. The second expansion segment 14 includes a first end 22 and a second end 24. The third expansion segment includes a first end 26 and a second end 28. The fourth connection segment includes a first end 30 and a second end 32. The close-up cross-sectional views of FIGS. 2A-2D illustrate an alternate embodiment of fabric structure 10 that has many of the same characteristics as the fabric structure 10 illustrated in FIG. 1, but that is woven differently in some aspects In the embodiment of FIG. 1, the first end 22 of the second expansion segment 14 is adjacent to the second end 20 of the first connection segment 12, the first end 26 of the third expansion segment 16 is adjacent to the second end 24 of the second expansion segment 14, and the first end 30 of the fourth connection segment 18 is adjacent to the second end 28 of the third expansion segment 16. In the embodiment shown in FIG. 1, the second expansion segment 14 also includes a transition area 62. The embodiment shown in FIGS. 2A-2D also includes a transition area, but the transition area has a different weaving pattern, as detailed below.

Figure 4:
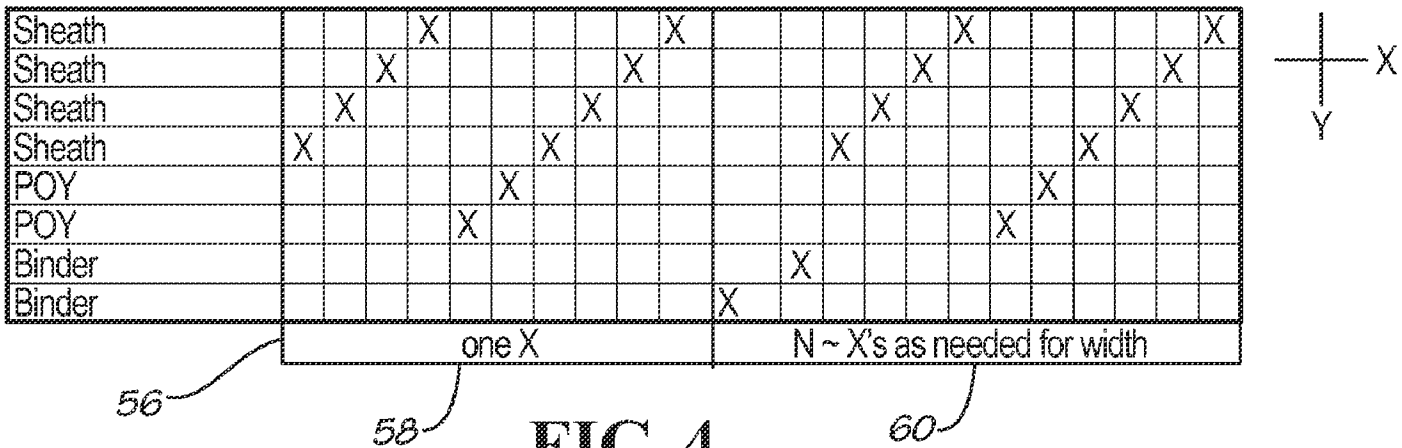
FIG. 4 is a draw-in diagram of the fabric structures of either FIG. 1 or FIGS. 2A-2D.
Figure 3A:
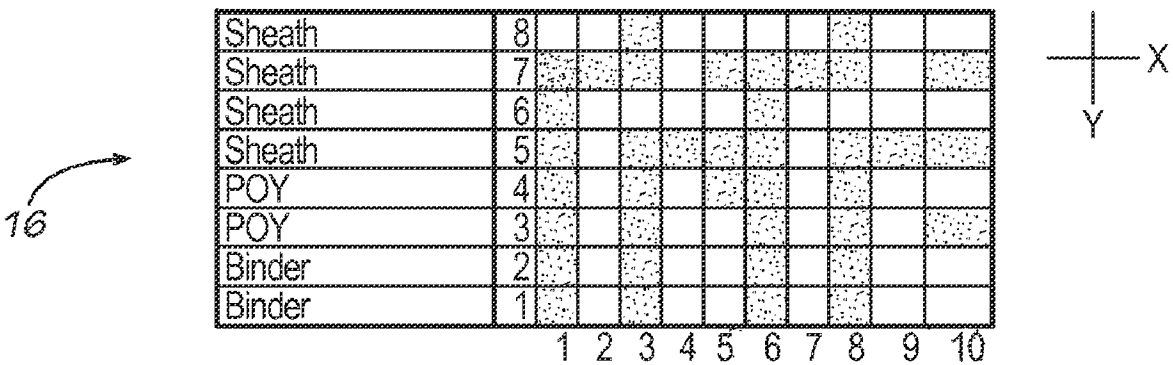
FIGS. 3A-3D are pick diagrams of the weaving patterns illustrated in FIGS. 2A-2D.
Figure 3B:
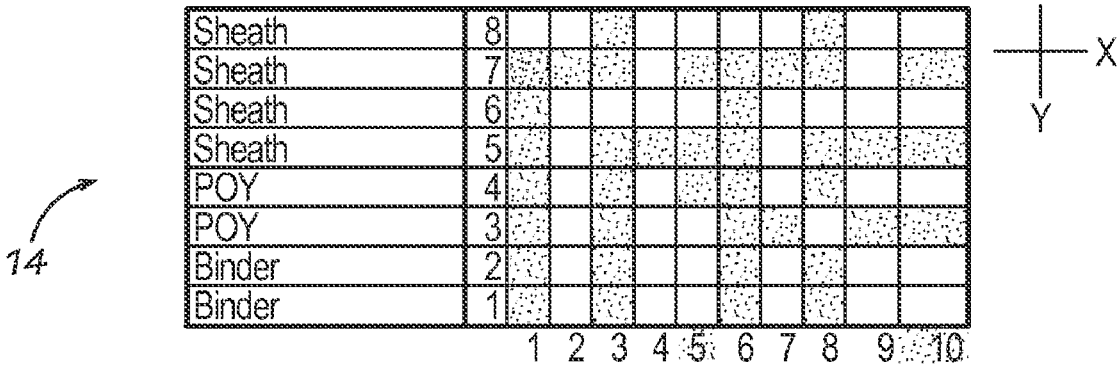
Figure 3C:
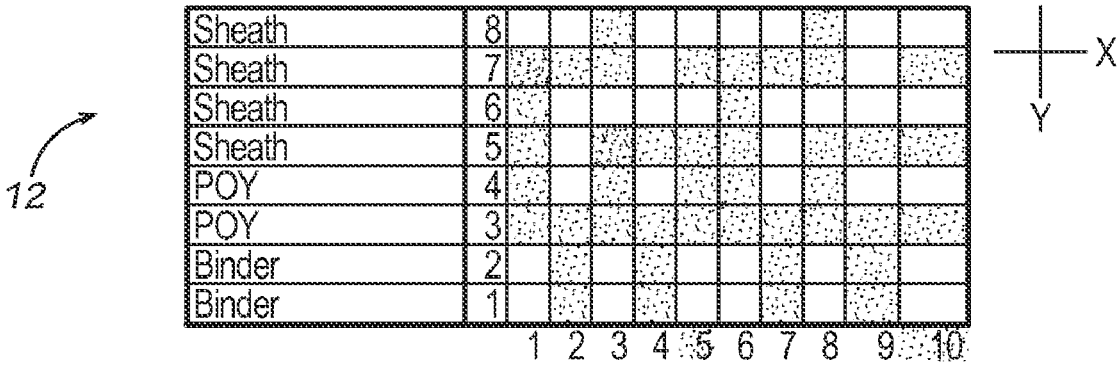
Figure 3D:
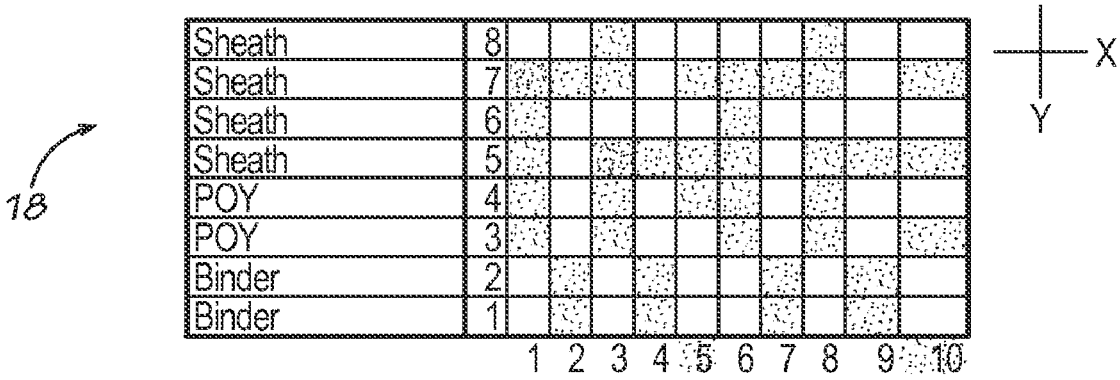
Figure 5:
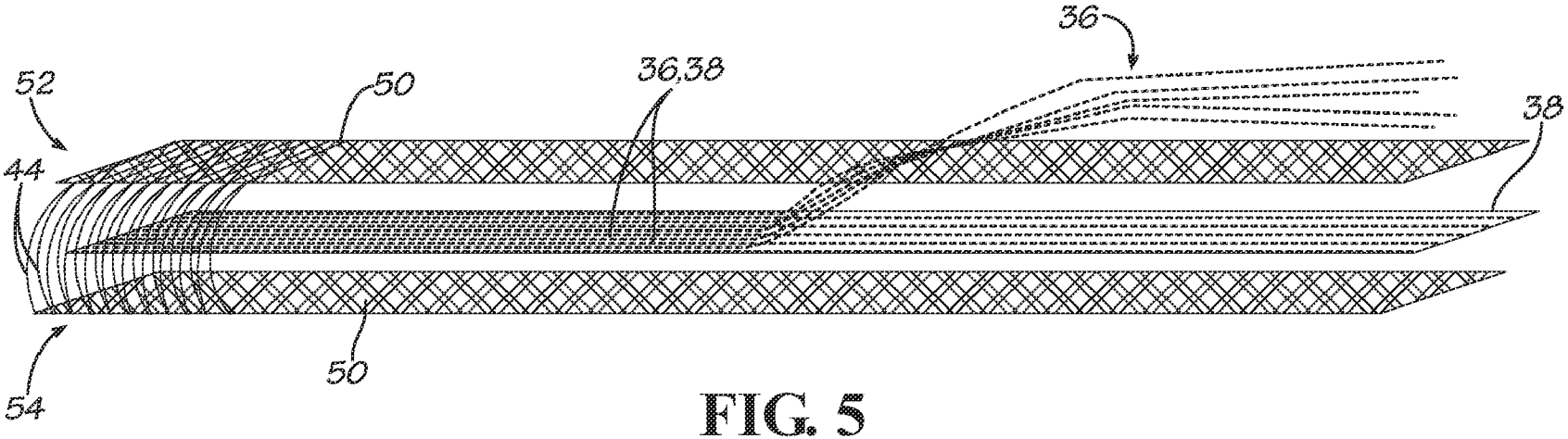
FIG. 5 is an exploded cross-sectional view of a fabric structure according to another embodiment of the invention.

In some embodiments, such as the embodiments of FIGS. 1-5, the fabric structure 10 includes a plurality of elongation yarn bundles, such as first elongation yarn bundle 36 and second elongation yarn bundle 38, each bundle comprising a plurality of elongation yarns, and a sheath 50 (illustrated in FIG. 5), which is formed from a plurality of ground yarns 40 and 42. As shown in FIG. 5, the sheath 50 includes a top layer 52 and a bottom layer 54. In some embodiments, fabric structure 10 includes more than two elongation yarn bundles. The elongation yarns and the ground yarns 40 and 42 can each be made from materials having any desired structure, for example, woven materials, braided materials, knitted materials, non-woven materials, and combinations thereof.

In one embodiment, the ground yarns 40 and 42 are polyester and each have a linear density of approximately 2,600 denier. In some embodiments, ground yarns 40 and 42 are nylon, polyester, Kevlar®, or any other high modulus, high tenacity yarn or other suitable materials that are relatively higher strength and that do not shrink or shrink substantially less than the elongation yarns during heat treatment. For example, in some embodiments, the ground yarns 40 and 42 forming the sheath 50 have a tensile strength of at least 5,000 pounds. In other embodiments, the ground yarns have a nominal breaking strength of greater than 5,400 pounds and, in some embodiments, have a nominal breaking strength exceeding 6,000 pounds, in compliance with 29 C.F.R. 1926.104(d) (2008), American National Standards Institute ("ANSI") Z335.1, Canadian standard Z259.1.1 Class 1A and 1B, European standard BS EN 355:2002, and Australian standard AN/NZS 1891.1.1995.

The elongation yarns that make up elongation yarn bundles 36 and 38 are highly extensible and significantly stretch when placed under a tensile load. The elongation yarns can have any desired configuration, such as woven together or non-woven, for example. Elongation yarn bundles 36 and 38 may have the same number of elongation yarns in each bundle, or may have a different number of elongation yarns. For example, in one embodiment, the elongation yarn bundle 36 includes approximately 5 elongation yarns and the elongation yarn bundle 38 includes approximately 10 elongation yarns.

The elongation yarns are one example of shock absorbing members of the fabric structure 10. In one embodiment, the elongation yarns making up the elongation yarn bundles 36 and 38 are partially oriented yarns (POY) made of polymer materials such as polyester, but the elongation yarns can be made from one or more suitable materials having high elongation properties and the ability to shrink in length, such as during heat treatment. The high elongation properties of the elongation yarns allow the elongation yarns to stretch significantly under a predetermined tensile force. The elongation yarns have this elongation property even after heat treatment. When the fabric structure 10 is placed under tensile load, the elongation yarns stretch under tension and absorb the force or energy applied to the fabric structure 10. In this way, the elongation yarns of elongation yarn bundles 36 and 38 are a shock absorbing member that provides a shock absorbing feature.

In some embodiments, each of the elongation yarns has a linear density of between approximately 300 denier and approximately 5,580 denier. Together, elongation yarn bundle 36 has a linear density of approximately 33,480 denier in some embodiments and elongation yarn bundle 38 has a linear density of approximately 34,000 denier in some embodiments.

As described above, the fabric structure 10 has a first connection segment 12, a second expansion segment 14, a third expansion segment 16, and a fourth connection segment 18. As shown in FIG. 1, the ground yarns 40 and 42 and the elongation yarn bundles 36 and 38 extend in a substantially warp direction throughout the fabric structure 10. In third expansion segment 16 and fourth connection segment 18, the sheath 50 surrounds both elongation yarn bundles 36 and 38.

As shown in FIG. 1, in some embodiments, the elongation yarn bundles 36 and 38 are generally parallel to one another and extend as stuffers throughout the structure in the third expansion segment 16 and the fourth connection segment 18. In other embodiments (as shown in FIGS. 2A-2D), the elongation yarn bundles 36 and 38 may be woven together in certain segments, and/or woven with the sheath using lateral yarns 46, discussed further below. The sheath 50 has other configurations in alternate embodiments.

In fourth connection segment 18, the elongation yarn bundles 36 and 38 and the ground yarns 40 and 42 of the sheath 50 are connected and secured together. In the embodiment shown in FIG. 1, the elongation yarn bundles 36 and 38 and the ground yarns 40 and 42 can be integrally woven or interlaced together with binder yarns 44. Like the elongation yarns and the ground yarns 40 and 42, binder yarns 44 also extend in a substantially warp direction in the fabric structure 10. In some embodiments, the binder yarns 44 are lighter, smaller denier yarns than the ground yarns. For example, in some embodiments where the ground yarns are 2600 denier, the binder yarns can be between approximately 300-1500 denier polyester yarns. In other embodiments, the binder yarns can be industrial filament polyester, nylon, Nomex®, Kevlar®, or any other suitable yarn. The interlaced weaving of the elongation yarn bundles 36 and 38 and the ground yarns 40 and 42 secures the two types of yarns together in the fourth connection segment 18 during weaving of the fabric structure 10. Preferably, the elongation yarns bundles 36 and 38 are secured to the sheath 50 such that the elongation yarns and the sheath 50 cannot be readily separated at the fourth connection segment 18. The elongation yarns also can be secured to the sheath 50 by stitching the elongation yarns and the ground yarns 40 and 42 of the sheath together.

According to the embodiment shown in FIG. 1, in third expansion segment 16, the elongation yarn bundles 36 and 38 extend in a substantially warp direction between the top and bottom of the sheath 50, but are not secured to the ground yarns 40 and 42 of the sheath 50. Because the elongation yarn bundles 36 and 38 are not secured to the ground yarns 40 and 42, when the elongation yarns in third expansion segment 16 shrink during heat treatment, they gather the sheath 50. As shown in FIG. 1, in third expansion segment 16, binder yarns 44 extend loosely in a substantially warp direction in between the top layer and bottom layer of the sheath 50. In other embodiments, binder yarns 44 could instead be interwoven with ground yarns 40 and 42 or could be in any other suitable configuration where they do not secure the ground yarns 40 and 42 with the elongation yarns.

In the embodiment of FIG. 1, in third expansion segment 16 and fourth connection segment 18, all of the elongation yarns are positioned in between the top and bottom layers of the sheath 50.

As shown in FIG. 1, in some embodiments, one of the elongation yarn bundles, such as elongation yarn bundle 36, is outside of the fabric structure 10 in second expansion segment 14 except in transition area 62. In the embodiment of FIG. 1, in the transition area 62, the elongation yarns of the elongation yarn bundle 36 are secured to the outside of the top layer of the sheath 50 and then to the inside of the top layer of the sheath 50. However, securing the elongation yarns of elongation yarn bundle 36 to the sheath 50 can be accomplished by many different weaves/configurations. For example, in the embodiment of FIG. 2B, the elongation yarn bundle 36 is woven with both the ground yarns 40 and 42 of the top layer 52 of the sheath 50 and the ground yarns 40 and 42 of the bottom layer 54 of the sheath 50 in the transition area.

In this way, the elongation yarn bundle 36 is secured to at least a portion of the sheath 50 in at least one part of second expansion segment 14 before elongation yarn bundle 36 is outside of the structure 10. Other configurations are possible to secure one (or more) of the elongation yarn bundles to either the top layer 52 or bottom layer 54 of the sheath 50, or both the top layer 52 and bottom layer 54 of the sheath 50, before the elongation yarn bundle is outside of the structure.

Because the elongation yarn bundle 38 is not secured to the ground yarns 40 and 42 in second expansion segment 14, the elongation yarns in elongation yarn bundle 38 shrink freely during heat treatment, and gather the sheath. As shown in FIG. 1, in second expansion segment 14, binder yarns 44 extend loosely in a substantially warp direction in between the top layer and bottom layer of the sheath 50. In other embodiments, binder yarns 44 could instead be interwoven with ground yarns 40 and 42 or could be in any other suitable configuration where they do not secure the ground yarns 40 and 42 with the elongation yarns. In some embodiments, elongation yarn bundle 36 is cut at second expansion segment 14. For example, as shown in FIG. 1, elongation yarn bundle 36 may be cut at or around cut point 48 before the fabric structure 10 is subjected to heat treatment (described below).

In first connection segment 12, the elongation yarn bundle that remains between the top and bottom layers of the sheath 50 (elongation yarn bundle 38 in the embodiment of FIG. 1) is connected and secured together with the ground yarns 40 and 42. In the embodiment shown in FIG. 1, the elongation yarn bundle 38 and the ground yarns 40 and 42 are integrally woven or interlaced together with binder yarns 44. Elongation yarn bundle 36 is completely outside the fabric structure 10 in first connection segment 12.

As shown in FIGS. 1 and 2A-2D, the fabric structure 10 in some embodiments also includes a plurality of lateral yarns 46 (also referred to as "weft" or "pick" yarns), the lateral yarns extending in an approximately weft direction across fabric structure 10. In some embodiments, the lateral yarns can be approximately 1,000 denier polyester yarns. In other embodiments, the lateral yarns can be industrial filament polyester, nylon, Nomex®, Kevlar®, or any other suitable yarn.

Figure 2A:
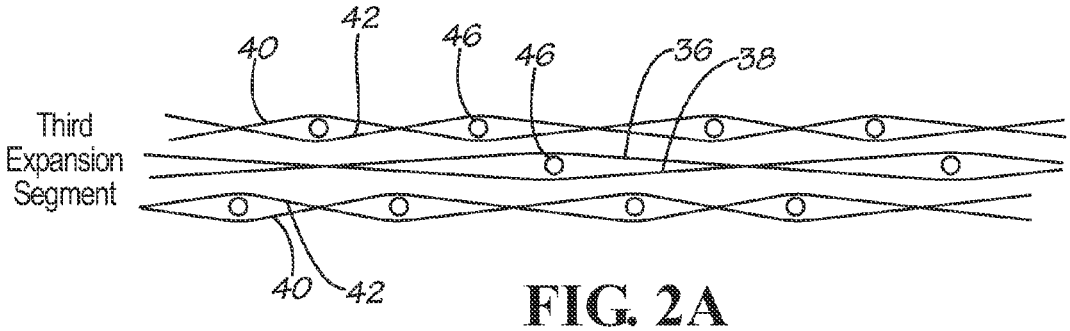
FIGS. 2A-2D are close-up cross-sectional views of weaving patterns of various segments of a fabric structure according to another embodiment of the invention.

As mentioned above, FIGS. 2A-2B are close-up views of various segments of an alternate embodiment of the fabric structure. FIG. 2A illustrates the third expansion segment, where the ground yarns 40 and 42 of the sheath 50 surround both elongation yarn bundles 36 and 38. In this embodiment, the elongation yarn bundles 36 and 38 are woven together. Moreover, lateral yarns 46 secure the elongation yarns to the ground yarns of the sheath 50 throughout the four segments. When the elongation yarns shrink during heat treatment, they gather the sheath 50. Lateral yarns 46 can be used to secure the elongation yarns to the sheath in certain segments to comply with Canadian Standard CSA Z259.11-05. In other embodiments, such as the embodiment shown in FIG. 1, the elongation yarns are not secured to each other and/or to the sheath throughout the second and third expansion segments 12 and 14.

Figure 2B:
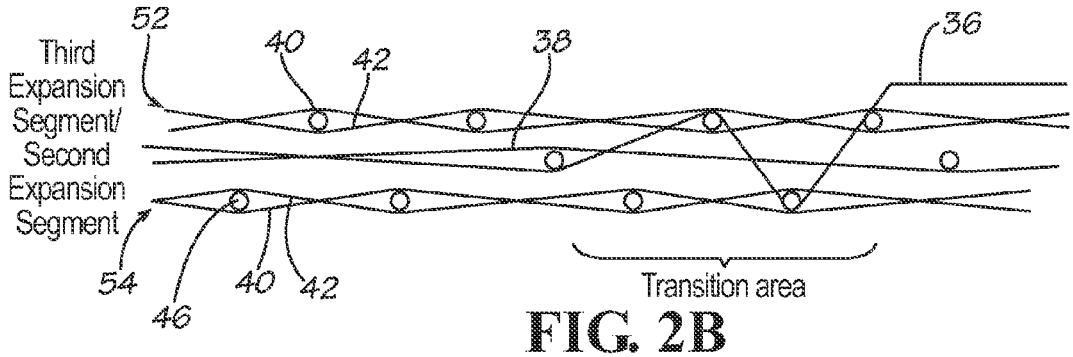

FIG. 2B illustrates a portion of third expansion segment, where the elongation yarn bundles 36 and 38 are woven together inside of the sheath 50, and also illustrates the transition area of second expansion segment, where the elongation yarn bundle 36 is secured to the ground yarns 40 and 42. FIG. 2B also illustrates the portion of second expansion segment where the elongation yarn bundle 36 is outside the fabric structure.

Figure 2C:
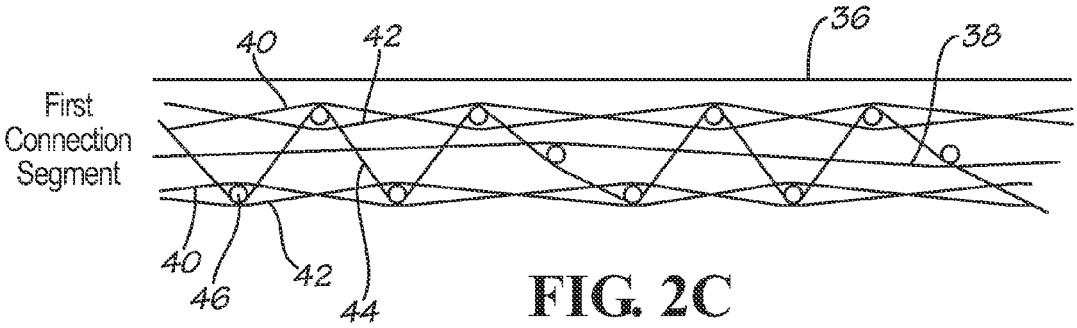
Figure 2D:
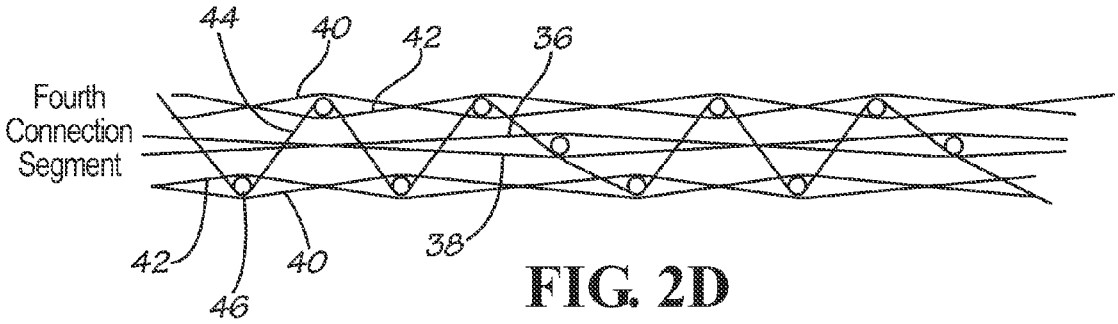

FIG. 2C illustrates the first connection segment, where the elongation yarn bundle 36 is completely outside the structure, and where the elongation yarns of elongation yarn bundle 38 and the ground yarns 40 and 42 are secured together with binder yarns 44. FIG. 2D illustrates the fourth connection segment, where the elongation yarn bundles 36 and 38 are woven together and are both surrounded by the sheath 50, and where the elongation yarns of the elongation yarn bundles 36 and 38 are secured to the ground yarns 40 and 42 with binder yarns 44.

Fabric structures 10 may be formed on any desired programmable loom, such as a needle loom. FIGS. 3A-3D are pick diagrams (also known as a chain diagram or cam draft) for the weaving patterns shown in FIGS. 2A-2D, respectively. The squares along the x-axis represent the weaving path/throw of the lateral yarns 46, and the y-axis corresponds to groups of warp yarns (such as the elongation yarns/POY, the binder yarns, and the ground yarns of the sheath). The pick diagrams of FIGS. 3A-3D show an eight harness loom. When a square is shaded, it indicates that the harness corresponding to that square is lifted as the lateral yarn 46 is thrown across the loom.

The draw-in diagram of FIG. 4 shows the placement of the elongation yarns and the ground yarns 40 and 42 in harnesses to produce the fabric structure 10 of FIG. 1 or FIGS. 2A-2D, while the pick diagrams of FIGS. 3A-3D represent the action of the harnesses with respect to the lateral yarns 46 to create the fabric structure 10. The y-axis of the draw-in diagram of FIG. 4 represents the number of harnesses of a loom used to make the fabric structure 10. In this embodiment, eight harnesses are used. In the embodiment shown in FIG. 4, the bottom two harnesses (harnesses 1-2) comprise the binder yarns 44, the next two harnesses (harnesses 3-4) comprise the elongation yarns, and the top four harnesses (harnesses 5-8) comprise the ground yarns 40 and 42 that form the sheath 50. The x-axis of FIG. 4 represents the yarns that are used to create the fabric structure 10, with row 56 showing the number of times each section of the diagram repeats. For example, in one embodiment, the first section 58 repeats 1 time, while the second section 60 repeats as many times as needed to form a fabric structure having the desired width. The first column of FIG. 4 illustrates that the first yarn is in the fifth harness frame, and the second yarn is in the six harness frame. In one embodiment, the fabric structure may be formed on a Muller NF loom, but other suitable looms may be used.

Figure 6:
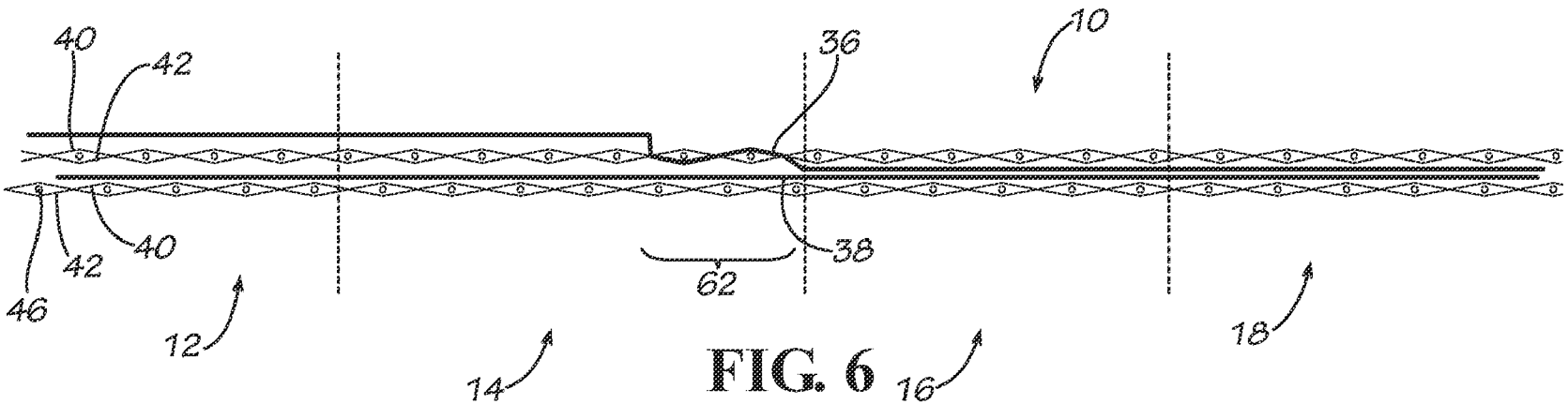
FIG. 6 is a cross-sectional view of a weaving pattern of a fabric structure according to another embodiment of the invention.

FIG. 6 illustrates another embodiment of fabric structure 10. The fabric structure illustrated in FIGS. 6-7 has many of the same properties and features described above. Unlike the fabric structure shown in FIGS. 1-5, however, the fabric structure of FIGS. 6-7 does not include binder yarns. Instead of using binder yarns, the fabric structure illustrated in FIG. 6 uses lateral yarns 46 to secure the ground yarns 40 and 42 and the elongation yarns in the first and fourth connection segments 12 and 18. The fourth connection segment 18 may be similar to FIG. 2A where the lateral yarns 46 secure the ground yarns 40 and 42 and the elongation yarns. The first connection segment 12 may be similar to the example shown in FIG. 2C, but without the binder yarns.

Figure 7A:
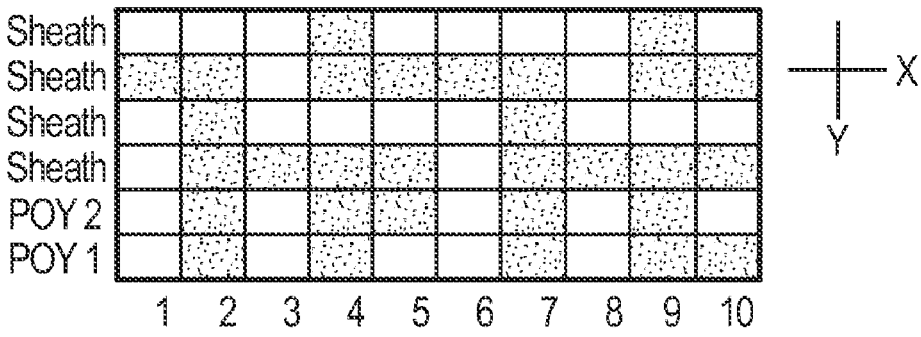
FIGS. 7A-7C are pick diagrams of the fabric structure of FIG. 6.
Figure 7B:
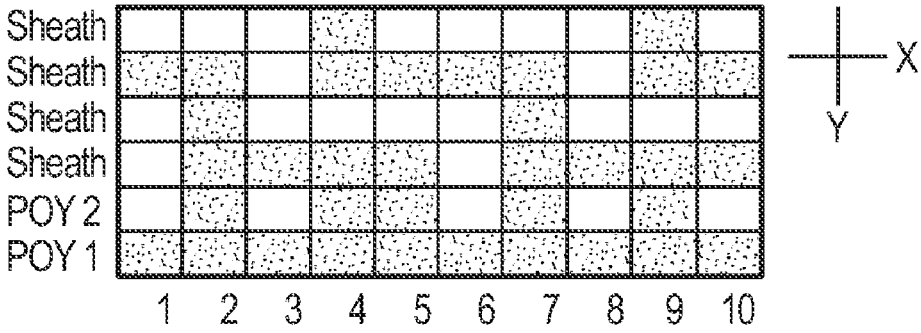
Figure 7C:
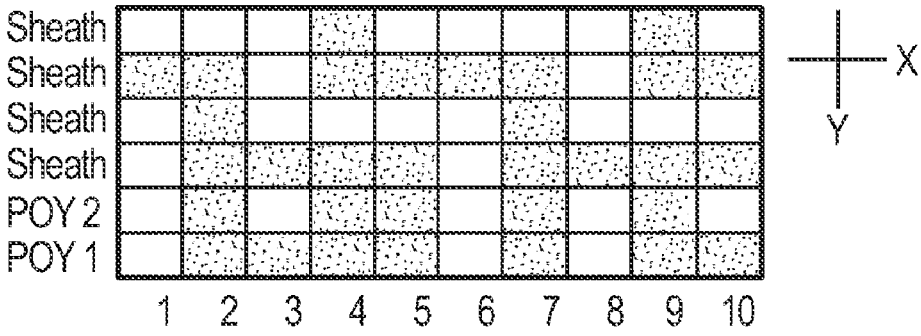

FIG. 7A shows the pick diagram for the weaving pattern of the ground yarns and the elongation yarns (POY) for first connection segment 12, third expansion segment 16, and fourth connection segment 18. Because this embodiment does not use binder yarns 44, the pick diagram for the first and fourth connection segments and the third expansion segment is the same. FIG. 7B shows the pick diagram for the weaving pattern of second expansion segment 14, with the exception of transition area. FIG. 7C shows the pick diagram for the weaving pattern of the transition area of the second expansion segment 14.

The draw-in diagram of FIG. 4 can be used to make the fabric structure illustrated in FIG. 6, although without the use of the binder yarns shown in the bottom two rows above row 56.

For all of the embodiments described above, including either the embodiment with binder yarns 44 or without binder yarns, the sheath 50 of fabric structure 10 is configured to support a load applied to the structure 10 if, in the expansion segments, the elongation yarns of elongation yarn bundles 36 and/or 38 fully elongate. The fabric structure 10 is formed by simultaneous weaving of the elongation yarns with the ground yarns 40 and 42 of the sheath 50. Thus, the fabric structure 10 is woven as a one-piece structure.

Also for all embodiments described above, the relative lengths of the elongation yarns of the elongation yarn bundles and the ground yarns of the sheath in the finished fabric structure 10 provide for proper elongation of the formed fabric structure 10 (stretching of the elongation yarns and unfolding of the sheath 50 in the expansion segments) to stop a person's fall or forward movement and reduce the shock force otherwise felt by the person. The relative lengths of the elongation yarns and the sheath 50 can be conveniently and accurately controlled by subjecting the fabric structure 10 to heat treatment. The heat treating process provides convenient and accurate control of the relative lengths by shrinking the elongation yarns of the elongation yarn bundles 36 and 38 relative to the sheath 50, preferably after the elongation yarns and the ground yarns are secured together in the first and fourth connection segments 12 and 18. As mentioned above, the elongation yarn bundle 36 can be cut at or around cut point 48 before subjecting the structure to heat treatment.

Upon the application of heat, the relative lengths of the elongation yarns and the sheath 50 are automatically adjusted. As stated above, the elongation yarns are made of one or more materials that shrink in length during heat treatment, while the ground yarns 40 and 42 of the sheath 50 are made of one or more materials that do not shrink in length or that shrink substantially less than the elongation yarns. As mentioned above, the length of the elongation yarns reduces significantly relative to the length of the ground yarns 40 and 42 of the sheath 50. Because the elongation yarns and the sheath 50 are connected together at the first connection segment 12 and the fourth connection segment 18, the shrinking of the elongation yarns draws the first connection segment 12 closer to the fourth connection segment 18. Because the length of the structure is dependent on the reduced-length elongation yarns, the sheath 50 gathers together or bunches up in the second and third expansion segments 14 and 16. In this manner, the sheath 30 automatically forms an accordion-like configuration in the second and third expansion segments 14 and 16 after heat treatment of the fabric structure 10. Accordingly, the relative lengths do not have to be adjusted before assembly of the elongation yarns to the sheath 30. This is in contrast to conventional lanyards, which had the relative lengths adjusted or set before assembly of the partially oriented yarns (POY) to the outer sheath.

Moreover, because the fabric structure 10 includes one or more elongation yarn bundles 36 that are woven outside of the structure in certain segments, the deployment force of the structure is not constant. As shown in the Figures, certain successive segments of fabric structure 10 have more elongation yarns woven inside the structure so that, at the third expansion segment 16 and the fourth connection segment 18, all of the elongation yarns are woven inside the structure 10. In this way, during a fall or sudden stop, the deployment force gradually increases the further the fabric structure 10 is stretched. Such a feature allows the fabric structure to be used by a wide variety of users, and in a wide variety of applications. For example, as shown by the load distribution curve in FIG. 8, the fabric structure is well suited for use by both a youth having a relatively lower weight and an adult having a relatively higher weight. The y-axis of FIG. 8 shows the force to which the fabric structure 10 is subjected (in pounds), while the x-axis of FIG. 8 shows the time elapsed (in approximately milliseconds) during a fall event.

Figure 8:
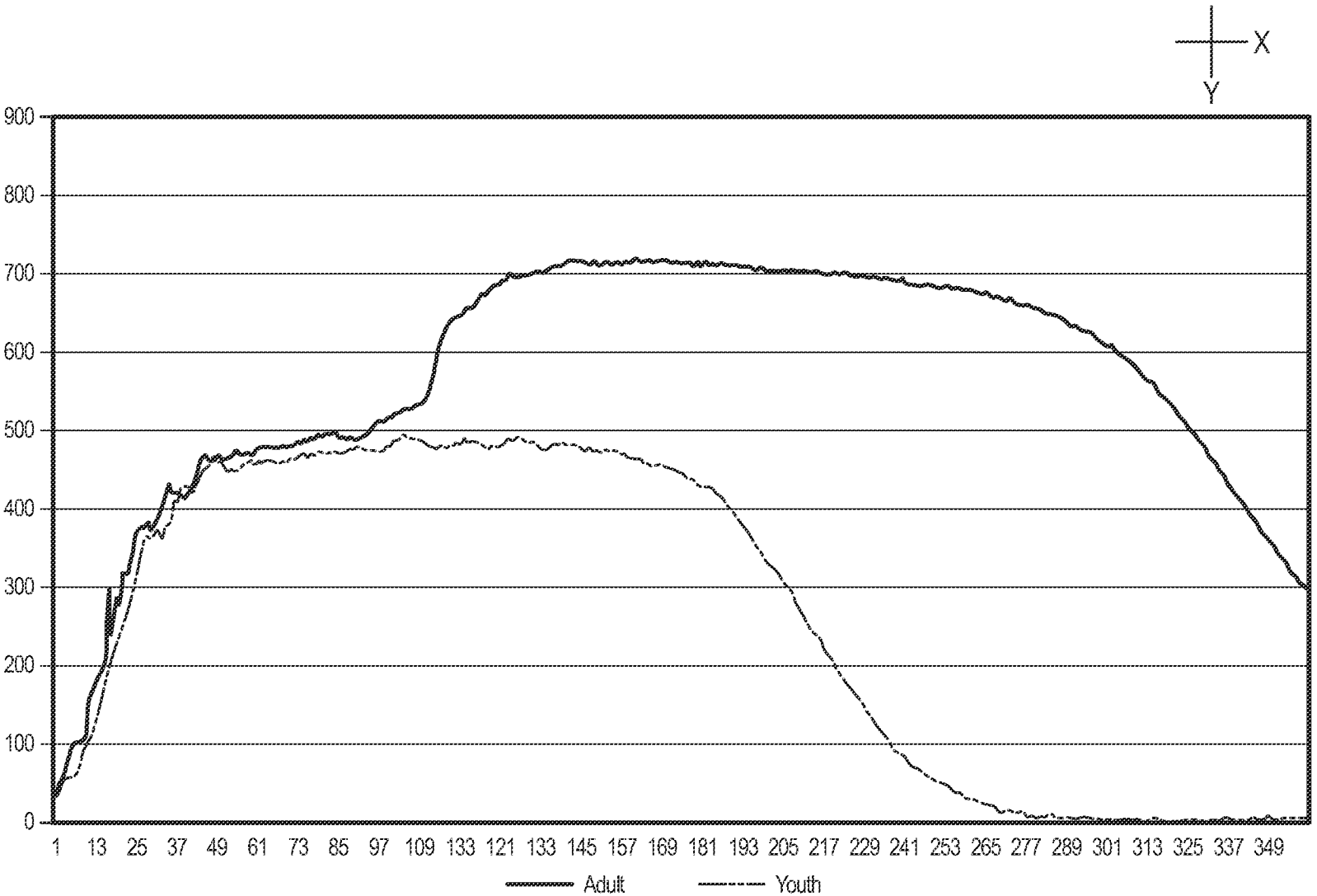
FIG. 8 is a graph illustrating the load distribution of a fabric structure according to one embodiment of the invention during two different fall events.

The fabric structure illustrated in FIG. 8 is configured so that the second expansion segment 14 (which only includes elongation yarn bundle 38) is deployed when the structure is subjected to around 500 pounds of force. The third expansion segment 16 of the fabric structure of FIG. 8 (which includes both elongation yarn bundles 36 and 38) is deployed when the structure is subjected to around 700 pounds of force. As shown in FIG. 8, the fall of the youth only subjects the fabric structure to enough energy to deploy the elongation yarns in the second expansion segment 14 of the fabric structure, which consists of the elongation yarns in elongation yarn bundle 38.

The fall of the adult, however, subjects the fabric structure to sufficient energy to deploy the elongation yarns in both the second expansion segment 14, which consists of the elongation yarns in the elongation yarn bundle 38, and the elongation yarns in the third expansion segment 16, which consists of the elongation yarns in both elongation yarn bundles 36 and 38. In this way, the fabric structure of FIG. 8 has two deployment stages—with deployment of a first set of elongation yarns occurring at approximately 500 pounds and deployment of a second set of elongation yarns occurring at approximately at 700 pounds. These two deployment stages therefore produce a stair-step load distribution curve.

As mentioned above, the amount of elongation yarns in the elongation yarn bundles 36 and 38 may or may not be equal, depending on the desired forces required to deploy the elongation yarns in each of the various expansion segments. Similarly, the fabric structure can include more than two elongation yarn bundles and more than two expansion segments, with the additional elongation yarn bundle(s) being outside the structure at the additional expansion segment(s) so that the fabric structure has more than two deployment stages. The various expansion segments can have many different configurations to create a fabric structure having multiple stages of deployment. By providing multiple deployment stages, the force experienced by both the youth and the adult is lessened.

Various heat treating processes can be used to shrink the elongation yarns of elongation yarn bundles 36 and 38 in the expansion segments. For example, a continuous oven can be used in an in-line, continuous heating process. The fabric structure can be continuously woven and fed into the continuous oven for heat treatment. After exiting the continuous oven, the continuous structure can be cut to a desired length to provide an individual fabric structure or lanyard. Another example of heat treatment is a batch process in which individual fabric structures are heat treated.

In one embodiment, the fabric structure 10 is a 4 foot by 1 and ⅜ inch nylon structure formed from approximately 248 nylon ground yarns (the ground yarns having a linear density of approximately 1680 denier), 20 nylon binder yarns (the binder yarns having a linear density of approximately 1680 denier), and 90 elongation yarns (the elongation yarns being partially oriented yarns with a linear density of approximately 5580 denier). In one embodiment, the fabric structure 10 made according to the draw-in diagram of FIG. 4 may be formed on a Mueller NFREQ needle loom. In some embodiments, the fabric structure 10 may be heat treated in an oven at a temperature of 249° F. for approximately 4.5 minutes.

At least one of the first and fourth connection segments 12 or 18 can be attached to a hardware component, such as a clip, a metal clasp, a harness, or a seatbelt component. For example, one of these connection segments can be attached to a harness worn by a user and the other connection segment can be attached to a load-supporting structure. In some embodiments, one of the first and fourth connection segments 12 or 18 can be attached to a harness and/or a clip for attachment to a child seat for use, for example, in an automobile or other vehicle.

The fabric structure 10 can be used as a fall protection device, to secure the occupant of a vehicle against harmful movement that may result from a sudden stop, or in any other application where rapid human or other body deceleration may occur. The fabric structure 10 can also be used as a tool lanyard to prevent a tool from falling/jerking off a scaffold or other elevated structure if dropped. When using the fabric structure as a fall protection device, one end of the fabric structure 10 is securely attached to a safety harness worn by a user. The opposite end of the fabric structure 10 is securely attached to a fixed structure. If the user falls, the fabric structure 10 stops the person's fall and reduces the shock felt by the person as the user is brought to a stop. As the person falls, the fabric structure 10 elongates or stretches and the load of the user begins to be applied to the fabric structure 10. The elongation yarns stretch and absorb the force of the load applied to the fabric structure 10. As the elongation yarns stretch, the sheath 50 elongates and the accordion shape unfolds. Under normal conditions, the elongation yarns will dissipate the energy of the fall and stop the person's fall before the sheath completely unfolds. However, if the elongation yarns stretch until they are equal in length to the sheath 50, then the sheath will stop the motion and support the load. The shock of stopping the fall that would otherwise be felt by the falling person is reduced or cushioned by the energy-absorbing elongation yarns.

In one embodiment, a fabric structure 10 is designed to stop a falling person within 3.5 feet, which is in compliance with 29 C.F.R. 1926.104(d) (2008). In this embodiment, the fabric structure 10 has a finished, ready-for-use length of about 6 feet. In other embodiments, the fabric structure has a finished, ready-to-use length of about 4 feet. The fabric structure 10 is formed from a woven webbing having a length of about 9.5 feet. After heat treatment, the elongation yarns have a reduced length of about 6 feet and the sheath 50 retains its 9.5 feet length. However, the sheath 50 is longitudinally gathered together to form the accordion-like shape over the 6 feet finished length. When the fabric structure is subjected to sufficient force, the elongation yarns will stretch from about 6 feet up to about 9.5 feet, unfolding the accordion-shaped sheath 50 up to the maximum length of about 9.5 feet. The elongation yarns absorb the energy of the fall and reduce the abrupt shock to the person when the fabric structure 10 stops the fall.

In another embodiment of the present invention, a fabric structure has lengths of the elongation yarns and the sheath to stop a falling person within about 11.75 feet. The fabric structures, however, can be made in any desired length according to the present invention.

Figure 9:
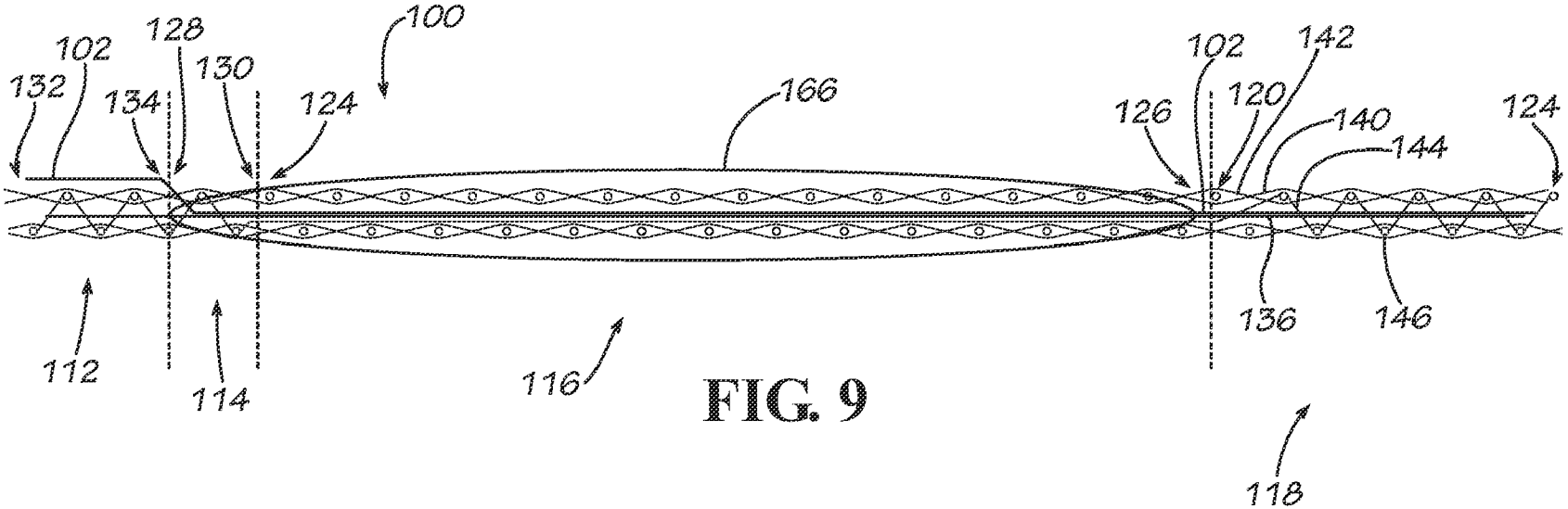
FIG. 9 is a cross-sectional view of a weaving pattern of a fabric structure according to another embodiment of the invention.

In some embodiments, as shown in FIG. 9, fabric structure 100 may include a band 102. In some embodiments, band 102 is a relatively small, narrow webbing that is woven inside the fabric structure at certain segments. In some embodiments, the band 102 is a relatively high elongation band comprised of any suitable material, such as nylon, polyester, POY, and/or Lycra® material, or any other suitable material or combination thereof. In some embodiments, the band 102 is designed to break when subjected to approximately 500-700 pounds of force. FIGS. 10A-10D show an alternate embodiment of a fabric structure including a band 102. The fabric structure of FIGS. 10A-10D has many of the same features and properties of fabric structure 100 of FIG. 9, but includes differences in weaving and number of elongation bundles, as discussed below.

In some embodiments, band 102 incorporates elastic. In certain embodiments, the band includes 20% elastic by weight. Any suitable elastic material may be used, such as split rubber, covered rubber, Lycra®, or any other suitable elastic material. In some embodiments, a separate elastic band is used in addition to band 102. For example, the elastic band may be formed from 20 Lycra® yarns having a linear density of approximately 2,500 denier and the band may be formed from 41 polyester yarns having a linear density of approximately 1,000 denier.

Fabric structures 100 including band 102 can be configured to comply with Canadian Standard Z259.11-05, section 5.2.3, which requires a reinforcement in the structure to prevent slight extension when the structure is subjected to small forces. One way to meet the reinforcement requirement is to include elastic in the band to draw the structure up so that it is as short as possible until the structure is deployed. This minimizes the amount of excess material associated with the fabric structure, which could pose a trip hazard.

The fabric structure 100 of FIG. 9 has a first connection segment 112, a second connection segment 114, a third expansion segment 116, and a fourth connection segment 118. As shown in FIG. 9, ground yarns 140 and 142 (which can have many of the same characteristics and features as ground yarns 40 and 42 described above), elongation yarn bundle 136 (which can have many of the same characteristics and features as elongation yarn bundle 36 described above), and the band 102 extend in a substantially warp direction throughout the fabric structure 100.

In fourth connection segment 118, the elongation yarn bundle 136 and the ground yarns 140 and 142 of the sheath 150 are connected and secured together. In the embodiment shown in FIG. 9, elongation yarn bundle 136, band 102, and ground yarns 140 and 142 can be integrally woven or interlaced together with binder yarns 144. Like the elongation yarns and the ground yarns 140 and 142, binder yarns 144 also extend in a substantially warp direction in the fabric structure 100. The interlaced weaving of elongation yarn bundle 136, band 102, and ground yarns 140 and 142 secures these yarns together in the fourth connection segment 118 during weaving of the fabric structure 110. Preferably, the elongation yarn bundle 136 and the band are secured to the sheath such that the elongation yarns, the band, and the sheath cannot be readily separated at the fourth connection segment 118. The elongation yarns and/or the band also can be secured to the sheath by stitching the elongation yarns and/or the band and the ground yarns 140 and 142 together.

In the embodiment shown in FIG. 9, in third expansion segment 116, elongation yarn bundle 136 and the band 102 extend in a substantially warp direction between the top and bottom of the sheath 150, but are not secured to the ground yarns 140 and 142 of the sheath. Because the elongation yarn bundle 136 is not secured to the ground yarns 140 and 142, when the elongation yarns in third expansion segment 116 shrink during heat treatment, they will gather the sheath. As shown in FIG. 9, in third expansion segment 116, binder yarns 144 extend loosely in a substantially warp direction in between the top layer and bottom layer of the sheath. In other embodiments, binder yarns 144 could instead be interwoven with ground yarns 140 and 142 or could be in any other suitable configuration where they do not secure the ground yarns 140 and 142 with the elongation yarns and the band 102.

In some embodiments, in the second connection segment 114, the band 102 is outside the fabric structure 100 completely. In the first and second connection segments 112 and 114, the elongation yarn bundle 136 is connected and secured together with the ground yarns 140 and 142. In the embodiment shown in FIG. 9, the elongation yarn bundle 136 and the ground yarns 140 and 142 are integrally woven or interlaced together with binder yarns 144.

As shown in FIGS. 9 and 10A-10D, the fabric structure 100 in some embodiments also includes a plurality of lateral yarns 146, the lateral yarns extending in an approximately weft direction across fabric structure 100. In some embodiments, the lateral yarns can be approximately 1,000 denier polyester yarns. In other embodiments, the lateral yarns can be industrial filament polyester, nylon, Nomex®, Kevlar®, or any other suitable yarn.

Figure 10A:
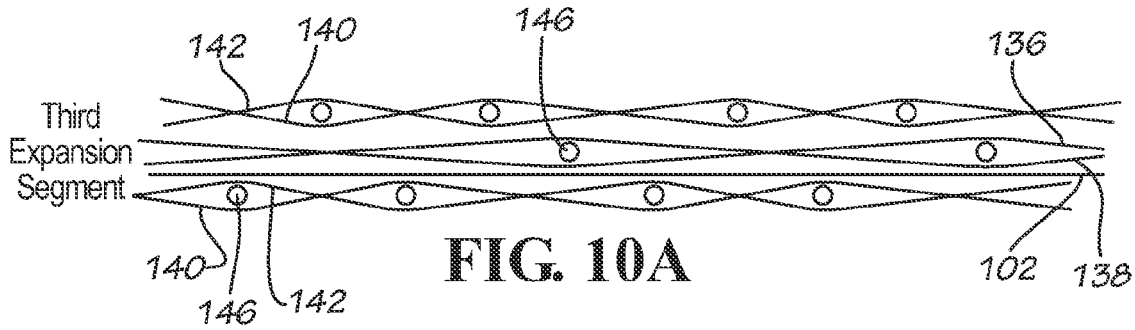
FIGS. 10A-10D are close-up cross-sectional views of the weaving patterns of various segments of the fabric structure of FIG. 9.

FIGS. 10A-10D are close-up views of various segments of an alternate embodiment of a fabric structure having a band 102. FIG. 10A illustrates the third expansion segment, where the ground yarns 40 and 42 of the sheath 50 surround elongation yarn bundles 136 and 138 and the band 102. In this embodiment, there is a second elongation yarn bundle 138, which is woven with elongation yarn bundle 136. In other embodiments (not shown), elongation yarn bundles 136 and 138 are generally parallel to one another and extend as stuffers throughout the structure and are not woven together. In the embodiment shown in FIGS. 10A-10D, lateral yarns 146 secure the elongation yarns to the ground yarns of the sheath throughout the four segments. In other embodiments, such as the embodiment shown in FIG. 9, the elongation yarns are not secured to the sheath throughout the second and third expansion segments 114 and 116.

Figure 10B:
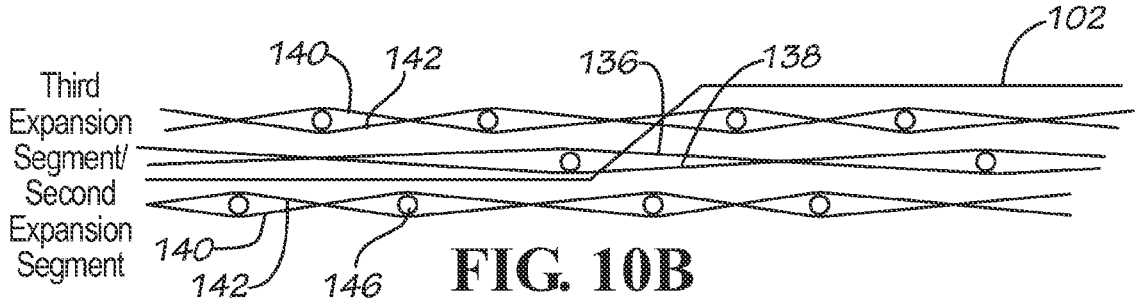

FIG. 10B illustrates a portion of third expansion segment, where the band 102 is inside the structure, and also illustrates the portion of second expansion segment where the band 102 is outside the fabric structure.

Figure 10C:
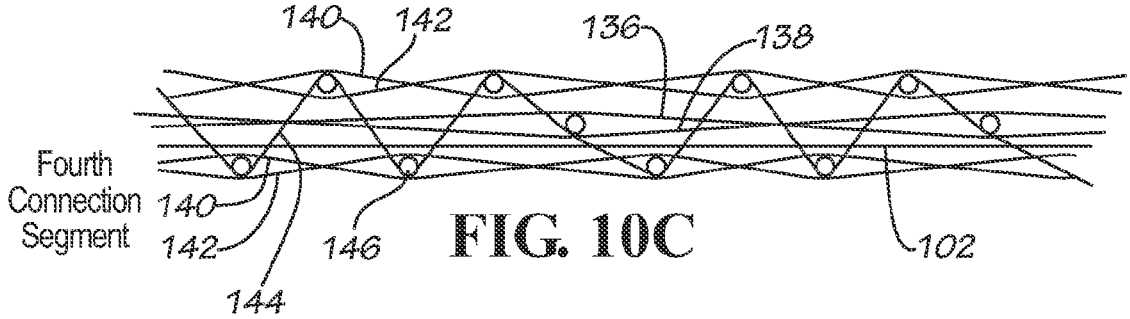
Figure 10D:
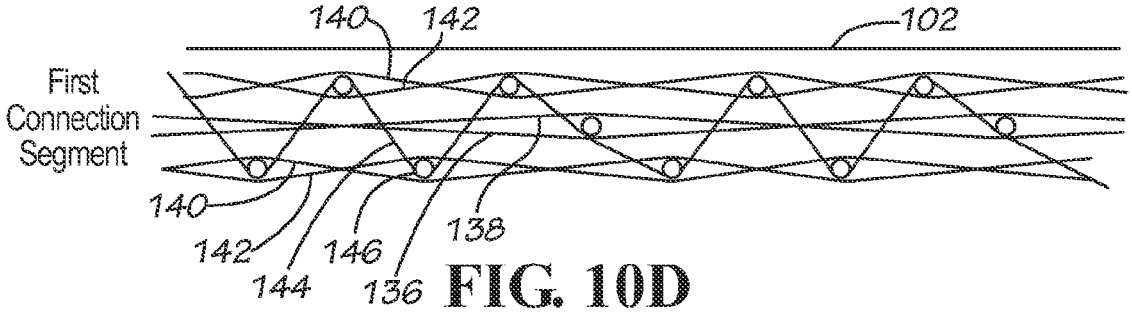

FIG. 10C illustrates the fourth connection segment, where the elongation yarn bundles 136 and 138 are woven together, and where the elongation yarns of the elongation yarn bundles 136 and 138 and the band 102 are secured to the ground yarns 140 and 142 with binder yarns 144. FIG. 10D illustrates the first connection segment, where the band 102 is completely outside the structure, and where the elongation yarns of elongation yarn bundles 136 and 138 and the ground yarns 140 and 142 are secured together with binder yarns 144.

Regardless of the composition of band 102, band 102 is woven with the rest of the structure under tension. If elastic is incorporated into the composition of band 102, then the tension is released after weaving, third expansion segment 116 is elastic. Moreover, in all embodiments, including the embodiment without binder yarns discussed below, band 102 extends loosely throughout the fabric structure and is not woven with the elongation yarns or the ground yarns.

Fabric structures 100 may be formed on any desired programmable loom, such as a needle loom. FIGS. 12A-12D are pick diagrams (also known as a chain diagram or cam draft) for the weaving patterns shown in FIGS. 10A-10D, respectively. The squares along the x-axis represent the weaving path/throw of the lateral yarns 146, and the y-axis corresponds to groups of warp yarns (such as the elongation yarns/POY, the binder yarns, the band, and the ground yarns of the sheath). The pick diagrams of FIGS. 12A-12D show a nine harness loom. When a square is shaded, it indicates that the harness corresponding to that square is lifted as the lateral yarn 146 is thrown across the loom.

Figure 11:
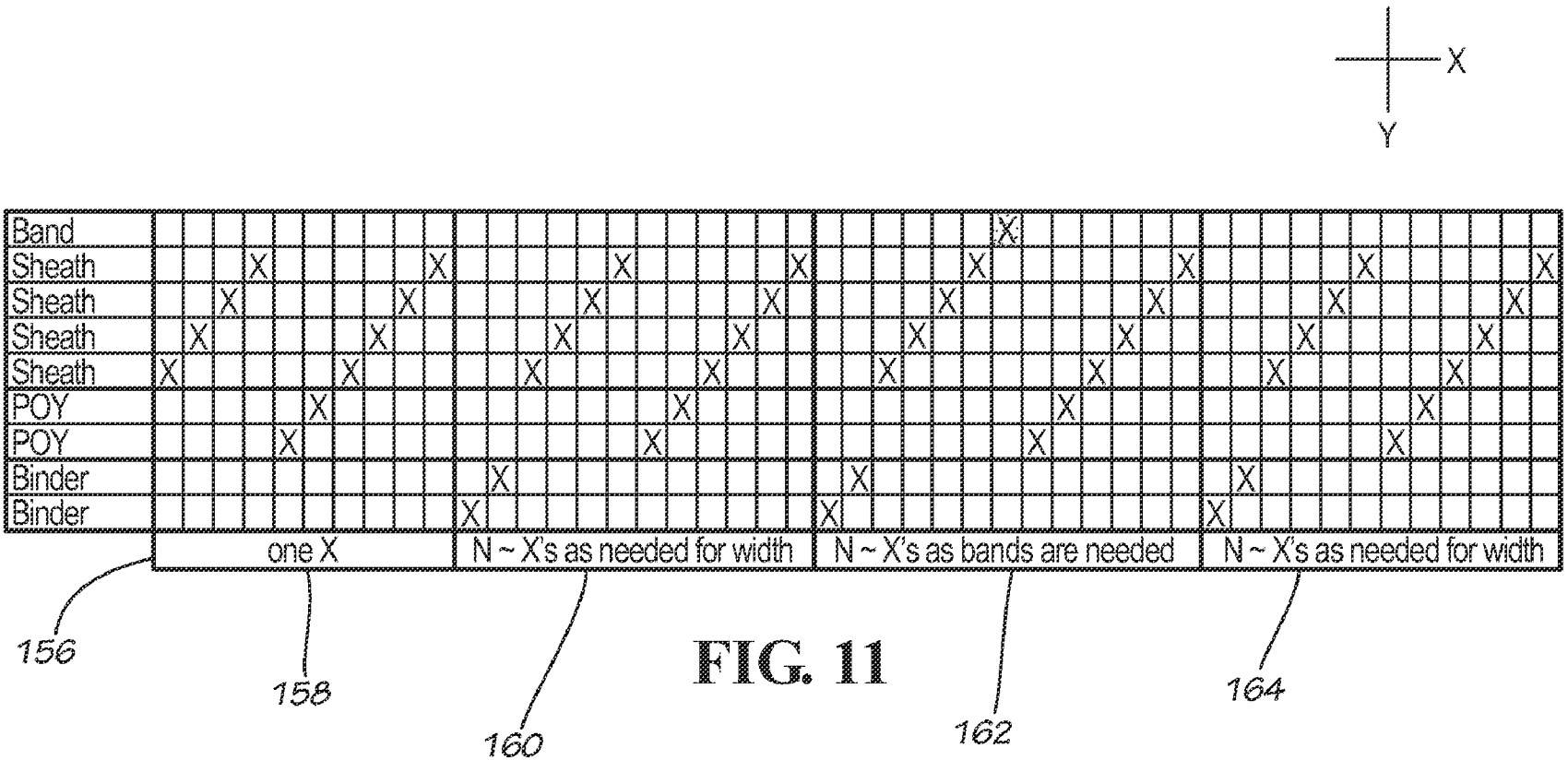
FIG. 11 is a draw-in diagram of the fabric structure of FIG. 9.
Figure 12A:
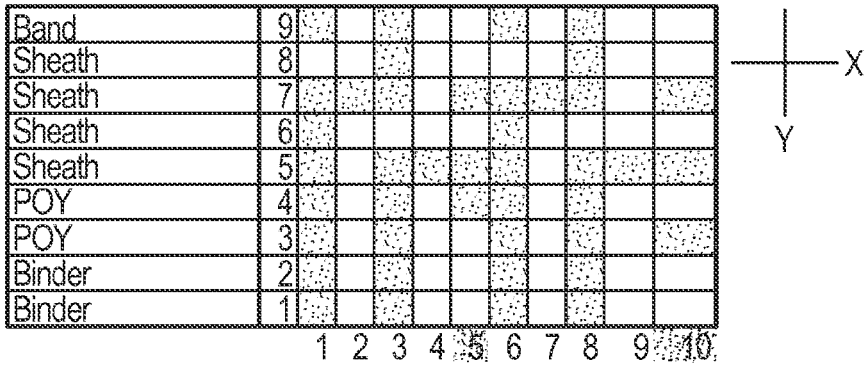
FIGS. 12A-12D are pick diagrams of the weaving patterns of FIGS. 10A-10D.
Figure 12B:
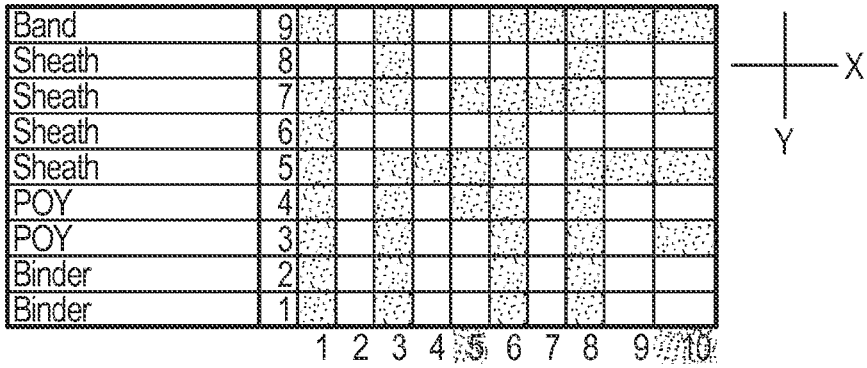
Figure 12C:
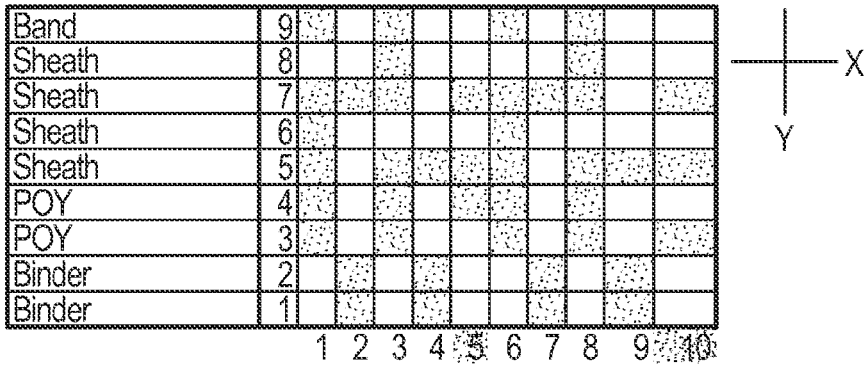
Figure 12D:
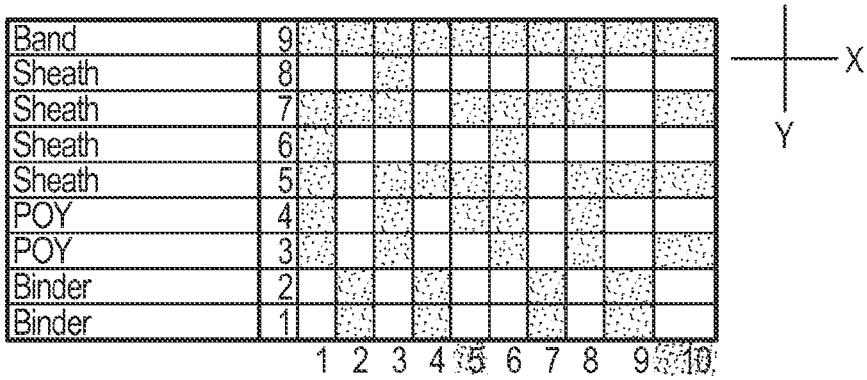

The draw-in diagram of FIG. 11 shows the placement of the elongation yarns, the ground yarns 140 and 142, and the band 102 in harnesses to produce the fabric structure 100 of FIGS. 9 and 10A-10D, while the pick diagrams of FIGS. 12A-12D represent the action of the harnesses with respect to the lateral yarns 146 to create the fabric structure 100 of FIGS. 10A-10D. The y-axis of the draw-in diagram of FIG. 11 represents the number of harnesses of a loom used to make the fabric structure 100. In this embodiment, nine harnesses are used. In the embodiment shown in FIG. 11, the bottom two harnesses (harnesses 1-2) comprise the binder yarns 144, the next two harnesses (harnesses 3-4) comprise the elongation yarns, and the next four harnesses (harnesses 5-8) comprise the ground yarns 140 and 142 that form the sheath, and the top harness (harness 9) comprises the yarns of band 102. The x-axis of FIG. 11 represents the yarns that are used to create the fabric structure 110, with row 156 showing the number of times each section of the diagram repeats. For example, in one embodiment, the first section 158 repeats one time, while the second through fourth sections 160-164 repeat as many times as needed to form a fabric structure having the desired width. The first column of FIG. 11 illustrates that the first yarn is in the fifth harness frame, and the second yarn is in the six harness frame. In one embodiment, the fabric structure may be formed on a Muller NF loom, but other suitable looms may be used.

Figure 13:
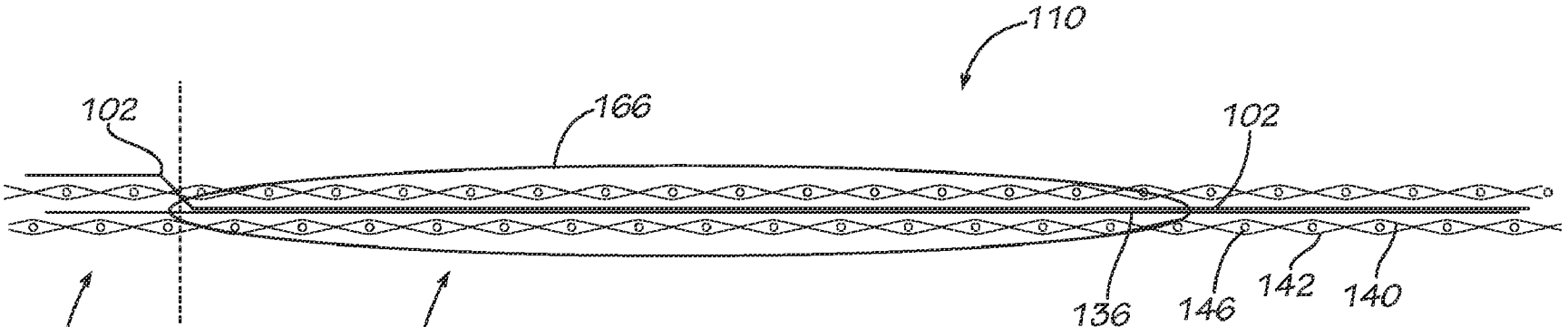
FIG. 13 is a cross-sectional view of a fabric structure according to an alternate embodiment of the invention.

FIG. 13 illustrates another embodiment of fabric structure 110. The fabric structure illustrated in FIG. 13 has many of the same properties and features as the fabric structures having a band 102 described above. Unlike the fabric structure shown in FIG. 9, however, the fabric structure of FIG. 13 does not include binder yarns. Instead of binder yarns, the fabric structure illustrated in FIG. 13 has lateral yarns 146 that secure the ground yarns 140 and 142 and the elongation yarns in the connection segments 112 and 118. As such, fabric structure 110 of FIG. 13 has two segments, first segment 180 and second segment 182. In second segment 182, band 102 extends loosely in between the sheath and is outside the structure 110 as it approaches the end of the first segment 180 adjacent to second segment 182. Thus, band 102 is outside of the structure at first segment 180. The first segment 180 may be similar to FIG. 10B, which illustrates one example where the lateral yarns 146 secure the ground yarns 140 and 142 and the elongation yarns and the band is outside the sheath. The second segment 182 may be similar to FIG. 10A, which illustrates one example where the lateral yarns 146 secure the ground yarns 140 and 142 and the elongation yarns and the band 102 is inside the sheath.

Figure 14A:
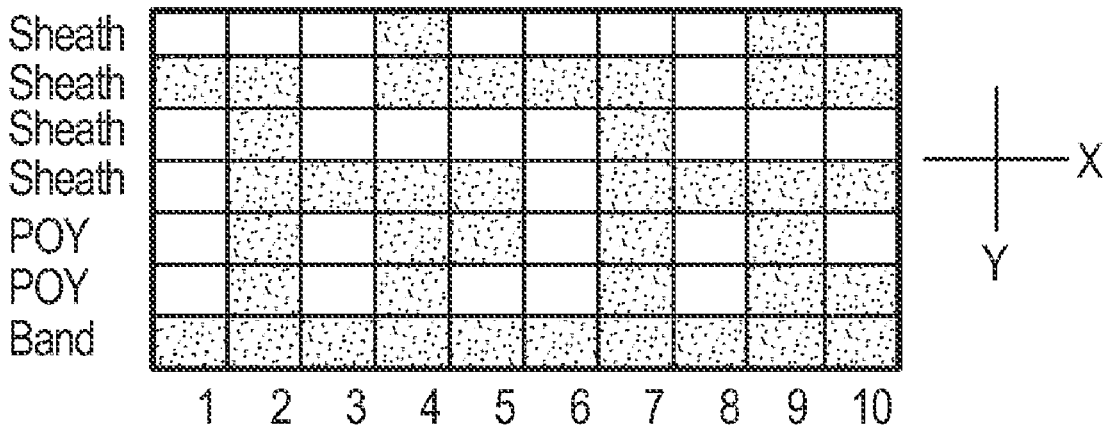
FIGS. 14A-B are pick diagrams of various segments of the fabric structure of FIG. 13.
Figure 14B:
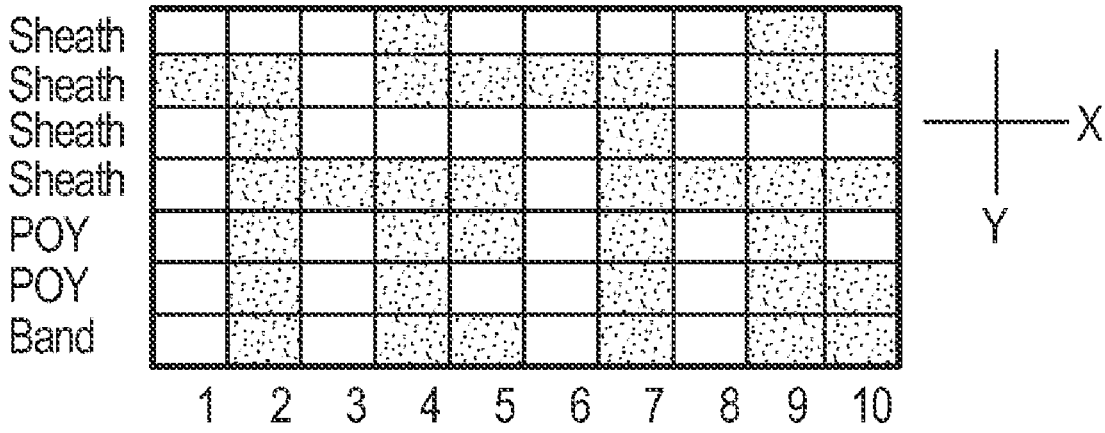

FIG. 14A shows the pick diagram for the weaving pattern of first segment 180 of fabric structure 110, while FIG. 14B shows the pick diagram for the weaving pattern of second segment 182. The draw-in diagram of FIG. 11 can be used to make the fabric structure of FIG. 13, except the binder yarns of the two rows above row 156 are not used.

Figure 15:
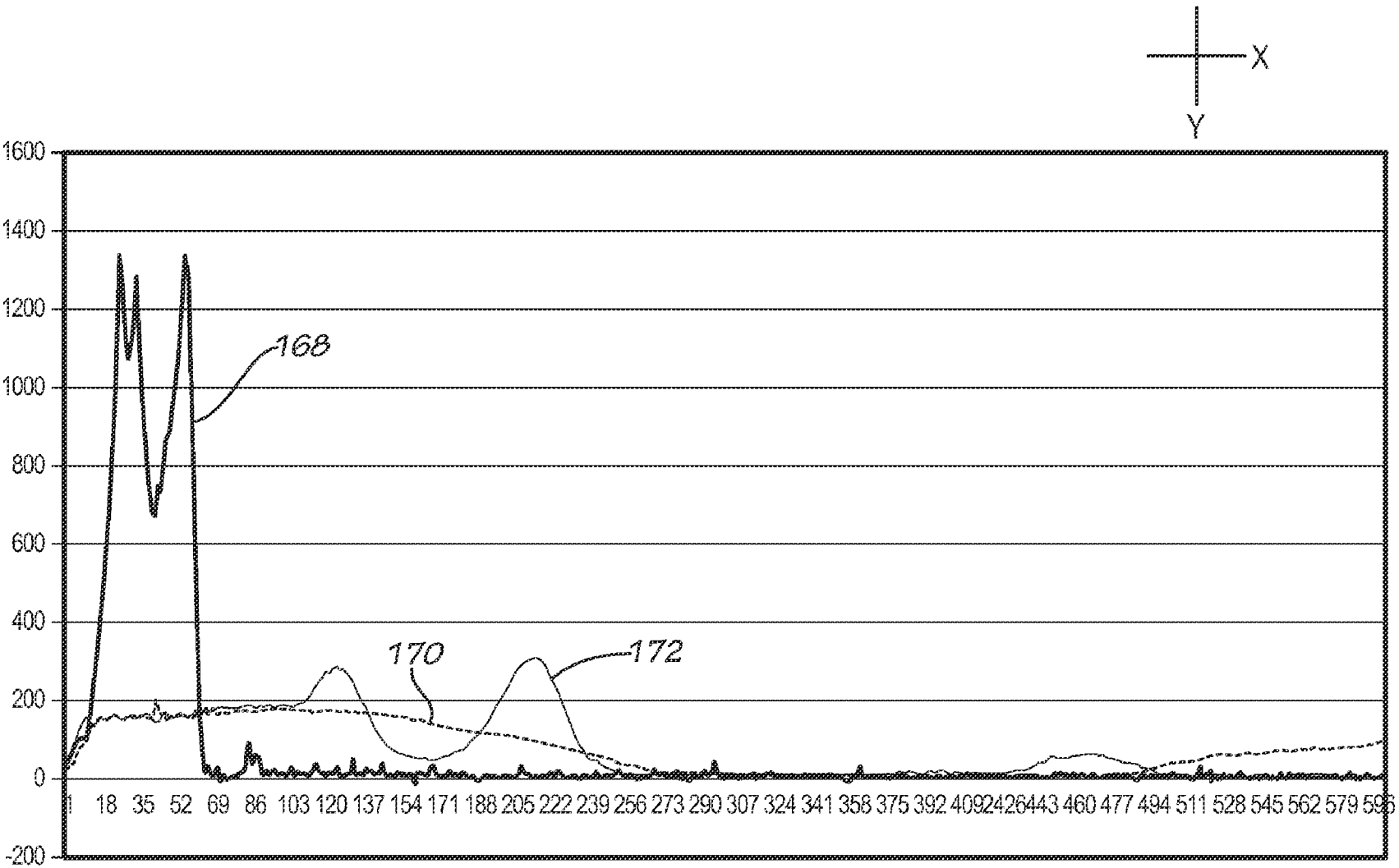
FIG. 15 is a graph illustrating the load distribution during a fall event of fabric structures having various compositions.

FIG. 15 shows a load distribution curve of various fabric structures subjected to a fall. The x-axis of this graph illustrates the time elapsed (in approximately milliseconds) and the y-axis of this graph illustrates the force to which the fabric structure is subjected (in pounds). Solid line 168 represents a control drop of a conventional standard lanyard with a 36 pound weight. This conventional standard lanyard does not have any shock absorbing features (such as elongation yarns), and is thus subjected to much greater forces than the lanyards represented by dotted line 170 and thin solid line 172. Dotted line 170 represents a drop of a 36 pound weight connected to a tool lanyard having elongation yarns (and thus a shock absorbing feature) and an elastic band 102 from a height of 48 inches. The fabric structure used in the fall of dotted line 170 experienced an approximately 15 inch elongation and a maximum arrest force of 198 pounds. Thin solid line 172 represents a drop of a 36 pound weight connected to a tool lanyard having elongation yarns (and thus a shock absorbing feature) and an elastic band from a height of 70 inches. The fabric structure used in the fall of thin solid line 172 experienced an approximately 12 inch elongation and a maximum arrest force of 301 pounds.

Various heat treating processes can be used to shrink the elongation yarns of elongation yarn bundle 136 and/or elongation yarn bundle 138 in any of the fabric structures described above with band 102 (including those with or without binder yarns 144). For example, as described above, a continuous oven can be used in an in-line, continuous heating process. The fabric structure can be continuously woven and fed into the continuous oven for heat treatment. After exiting the continuous oven, the continuous structure can be cut to a desired length to provide an individual fabric structure or lanyard. Another example of heat treatment is a batch process in which individual fabric structures are heat treated. In some embodiments, the fabric structure 100 or 110 may be heat treated in an oven at a temperature of 249° F. for approximately 4.5 minutes. In some embodiments, the areas outside of oval 166 are insulated from heat treatment.

Because the band 102 does not shrink when subjected to heat treatment, while the elongation yarns inside of oval 166 do shrink, the band 102 is longer than the elongation yarns in the portion of the structure represented by oval 166. The extra length of band 102 can then be manually pulled throughout the portion of the structure represented by oval 166 to even the length of the band 102 with the rest of the structure. In some embodiments, the band 102 is secured to the structure by stitching or other suitable means, and is then cut. In some embodiments, band 102 is cut around first end 128 of second segment 14 or around second end 134 of first segment 112.

In one embodiment, the fabric structures 100 or 110 are 4 foot by 1 and ⅜ inch nylon structures formed from approximately 248 nylon ground yarns (the ground yarns having a linear density of approximately 1680 denier), 20 nylon binder yarns (the binder yarns having a linear density of approximately 1680 denier), 90 elongation yarns (the elongation yarns being partially oriented yarns with a linear density of approximately 5580 denier), and 41 yarns with a linear density of approximately 1000 denier making up the band. In one embodiment, fabric structure 100 made according to the draw-in diagram of FIG. 11 may be formed on a Mueller NFREQ needle loom.

The fabric structures of the present invention can be made of any suitable materials including, but not limited to, synthetic material yarns woven to form the fabric structure.

Various changes and modifications to the above-described embodiments described herein will be apparent to those skilled in the art. Such changes and modifications can be made without departing from the spirit and scope of the invention and without diminishing its intended advantages. It is therefore intended that such changes and modifications be covered by the appended claims.

The invention claimed is:

1. A fabric structure comprising:

a plurality of ground yarns that form a sheath;

a plurality of elongation yarns, wherein the plurality of elongation yarns comprise partially oriented yarns; and a band capable of elongation, wherein the ground yarns, the elongation yarns, and the band extend in a substantially warp direction in the fabric structure and wherein the band is woven so that it is loose inside a portion of the fabric structure, wherein the sheath surrounds the plurality of elongation yarns, and wherein the sheath surrounds the band in at least a portion of the fabric structure, and wherein the band is outside the fabric structure in at least another portion of the fabric structure.

2. The fabric structure of claim 1, wherein the band includes elastic.

3. The fabric structure of claim 1, wherein the band has a breaking strength that is less than a breaking strength of the sheath.

4. The fabric structure of claim 1, wherein the band prevents the fabric structure from extending when subjected to a relatively small force.

5. A fabric structure comprising:

a plurality of ground yarns that form a sheath;

a plurality of elongation yarns, wherein the plurality of elongation yarns comprise partially oriented yarns; and a band, wherein the ground yarns, the elongation yarns, and the band extend in a substantially warp direction in the fabric structure and wherein the band is woven loosely inside the fabric structure, wherein the sheath surrounds the plurality of elongation yarns, wherein the sheath surrounds the band in at least a portion of the fabric structure, and wherein the band is outside the fabric structure in at least another portion of the fabric structure, and wherein the band causes the fabric structure to constrict so that a length of the fabric structure is less than it would be if the band were not present.

6. The fabric structure of claim 5, wherein the band comprises elastic.

* * * * *